US005133486A

United States Patent [19]

Moore et al.

[11] Patent Number: 5,133,486

[45] Date of Patent: Jul. 28, 1992

[54] TAMPER EVIDENT PULL RING POUR SPOUT

[75] Inventors: David N. Moore, Plainfield; Bridgett Zemlo, Glendale Heights; Richard J. Petro, Mokena, all of Ill.

[73] Assignee: Phoenix Closures, Inc., Naperville, Ill.

[21] Appl. No.: 642,825

[22] Filed: Jan. 18, 1991

[51] Int. Cl.[5] ..... B65D 47/10

[52] U.S. Cl. ..... 222/541; 220/258; 220/270

[58] Field of Search ..... 222/541; 220/270, 258; 215/305, 254, 255, 256

[56] References Cited

U.S. PATENT DOCUMENTS

| | | | |
|---|---|---|---|
| 3,135,441 | 6/1964 | Wise et al. | 222/541 |
| 3,160,327 | 12/1964 | Porcelli | 222/541 X |
| 3,269,617 | 8/1966 | Goth | 222/541 |
| 3,278,083 | 10/1966 | Serafini . | |
| 3,282,477 | 11/1966 | Henchert | 222/541 |
| 3,434,620 | 3/1969 | Lavrizio | 222/541 X |
| 3,768,698 | 10/1973 | Corty, Sr. et al. . | |
| 4,483,464 | 11/1984 | Nomura . | |
| 4,669,640 | 6/1987 | Ando et al. . | |
| 4,682,702 | 7/1987 | Gach | 222/541 X |
| 4,712,714 | 12/1987 | Mucciarone . | |
| 4,723,689 | 2/1988 | Vallos et al. . | |
| 4,795,065 | 1/1989 | Ashizawa et al. . | |
| 4,801,037 | 1/1989 | Hayashida et al. . | |
| 4,830,273 | 5/1989 | Kalberer et al. . | |
| 5,027,979 | 7/1991 | Kawajiri et al. | 222/541 X |

FOREIGN PATENT DOCUMENTS

| | | | |
|---|---|---|---|
| 340554 | 11/1989 | European Pat. Off. | 222/541 |
| 708330 | 6/1966 | Italy | 222/541 |
| 1124847 | 8/1968 | United Kingdom | 222/541 |
| 2233315 | 1/1991 | United Kingdom | 222/541 |

OTHER PUBLICATIONS

Photograph of Citrus Hill® orange juice container produced by International Paper Company, purchased on or about Nov. 13, 1990.

Photograph of Crisco® vegetable oil container with closure, Proctor & Gamble, Cincinnati, Ohio, purchased on or about Nov. 15, 1990.

*Primary Examiner*—Robert P. Olszewski
*Assistant Examiner*—Boris Milef
*Attorney, Agent, or Firm*—Welsh & Katz, Ltd.

[57] ABSTRACT

A tamper evident pull ring pour spout includes a tubular spout having an outer threaded surface, an inner surface, and a lower flange for attaching the spout to the container, a pull ring integrally formed in inner surface of the spout and configured to seal the spout, a finger tab disposed on the pull ring and adapted to facilitate the removal of the pull ring from the spout and a threaded cap dimensioned to threadably engage the spout and to reclose the closure upon the removal of the pull ring.

11 Claims, 2 Drawing Sheets

TAMPER EVIDENT PULL RING POUR SPOUT

BACKGROUND OF THE INVENTION

The present invention relates to tamper evident container closures, and more specifically to such a closure for attachment to disposable containers designed to dispense potable liquids such as milk or juice.

Conventional containers used for dispensing beverages are often made from a flat blank of paperboard, the outside surface of which is coated with a plastic such as polyethylene to give it strength and make it liquid impervious. Many such containers are provided with a gabled upper end. Such gabled containers often include an integral paper spout folded into a front or rear portion of the gable and designed to be folded out as the carton is opened for dispensing the contents.

A major drawback of such a spout is that the only way to reclose the container is to fold in the spout, which does not totally reseal the container. Thus there is a potential for premature spoilage of the container contents. A further drawback of such a spout is that for liquids which must be shaken prior to use, previously opened containers equipped with folded in spouts are prone to spillage of the contents upon shaking.

A preferred design criterion of such containers is that they be tamper evident. This objective is accomplished in the internal spout containers by inspecting the condition of the spout to determine if the container has been opened previously.

Attempts to address these drawbacks and design criterion have focused on the provision of a plastic spout having a removable cap as well a threaded pointed end designed for puncturing an opening in the container. Once the pointed end pierces the container, the threaded end is inserted into the container until the spout is properly seated. The disadvantages of this type of closure include increased piece part costs from more sophisticated tooling, as well as the extra material used for the threaded, pointed piercing end. Another disadvantage of such a closure is that the pointed end may not provide an adequate seal for the opened container.

Other attempts at addressing the above-identified drawbacks relate to attaching spouts or pull tabs to the container with adhesive. These closures include an integral snap fit plastic formation for reclosing the opening or spout. Although these latter spouts are not as expensive to produce as the piercing tip versions identified above, they are prone to the entire closure becoming detached from the container as the user pulls the tab upon opening the container.

Thus, there is a need for a tamper evident reclosable spout type closure for containers designed to dispense portable liquids, where the closure is effective in resealing the container after the initial opening. There is also a need for such a closure which is reliably secured to the container and is economical to produce.

SUMMARY OF THE INVENTION

Accordingly, a tamper evident pull ring pour spout closure for a container is provided which includes a tubular spout having an outer threaded surface, an inner surface and a lower flange for attaching the spout to the container. A readily severable pull ring is integrally formed in the inner surface of the spout and is configured to seal the spout, and a finger tab is disposed on the pull ring and is adapted to facilitate the removal of the pull ring from the spout.

In addition, the present closure includes a threaded cap which is dimensioned to threadably engage the spout and to reclose upon the removal of the pull ring. If desired, the pull tab may be provided with at least one tapered edge to facilitate the flexing of the tab into an angled position when the cap is initially threaded upon the spout during assembly.

DETAILED DESCRIPTION OF THE PREFERRED EMBODIMENT

Figure 1:
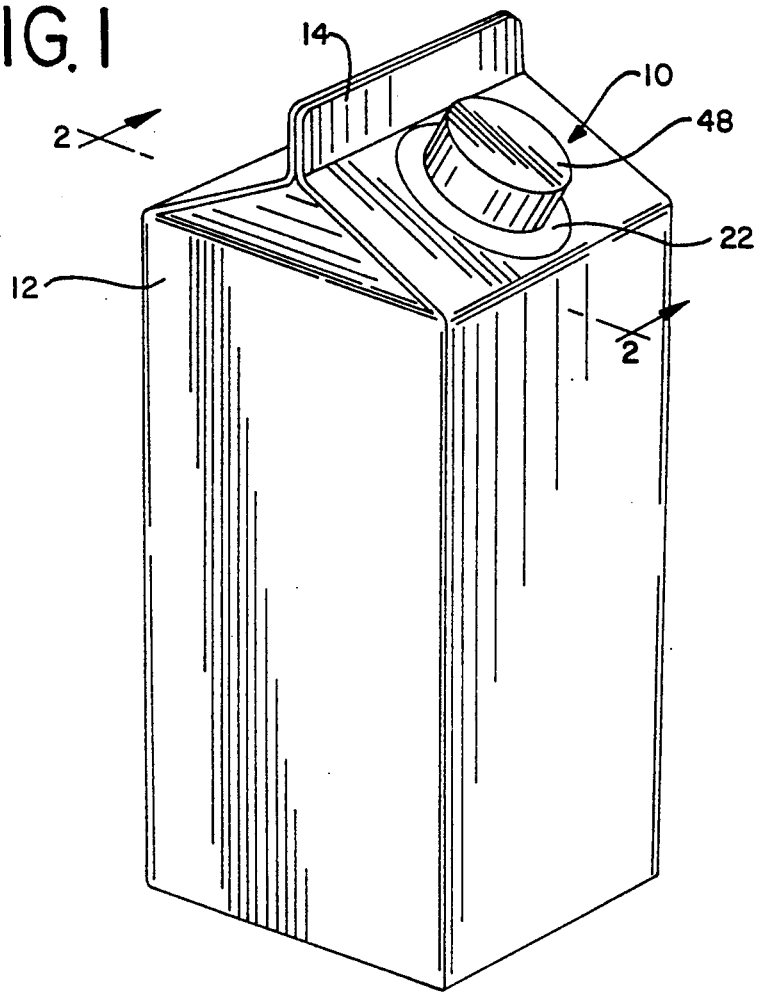
FIG. 1 is a perspective elevational view of a gabled container shown equipped with the closure of the invention.

Referring now of FIG. 1, the closure of the invention is indicated generally at 10 and is shown mounted upon a conventional gabled paperboard container 12 of the type used to dispense potable liquids such as milk or juice. The container 12 is preferably made from a flat blank of paperboard, the outside surface of which is coated with a plastic such as polyethylene to give it strength and to make it liquid impervious. The container 12 is shown provided with a gabled upper end 14, although it is contemplated that the present closure 10 may be effectively employed with other types of containers, including flat top type beverage containers.

Figure 2:
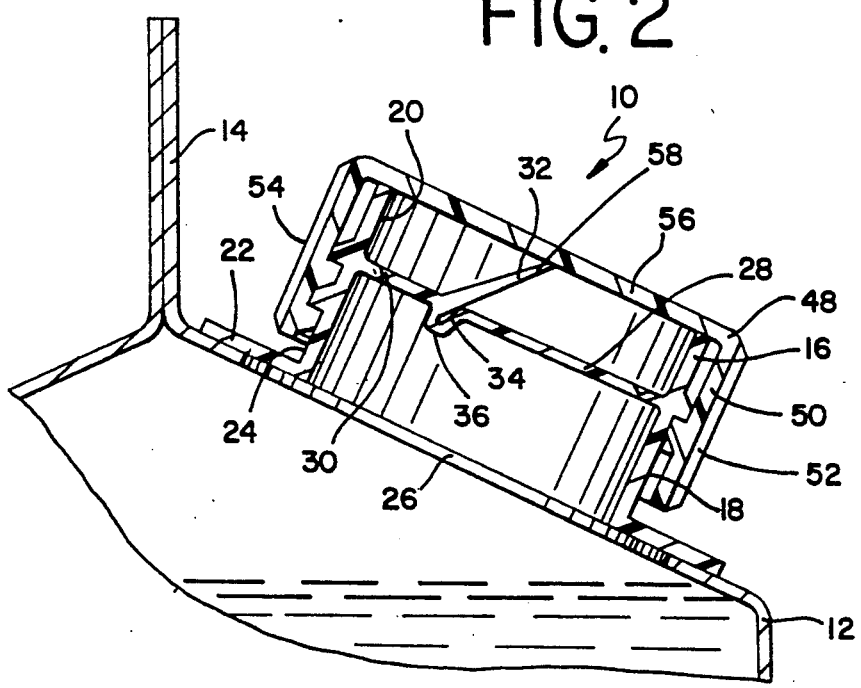
FIG. 2 is a sectional elevation taken along the line 2—2 of FIG. 1 and in the direction generally indicated.
Figure 3:
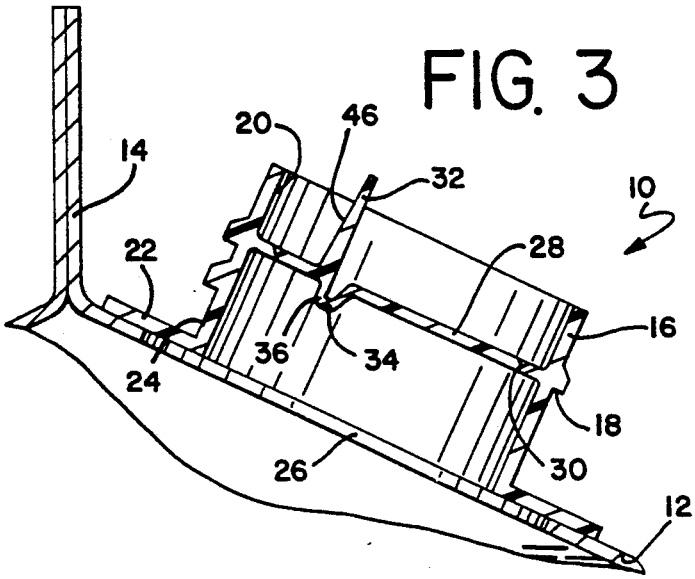
FIG. 3 is another view of the closure of FIG. 2 shown with the cap removed.
Figure 4:
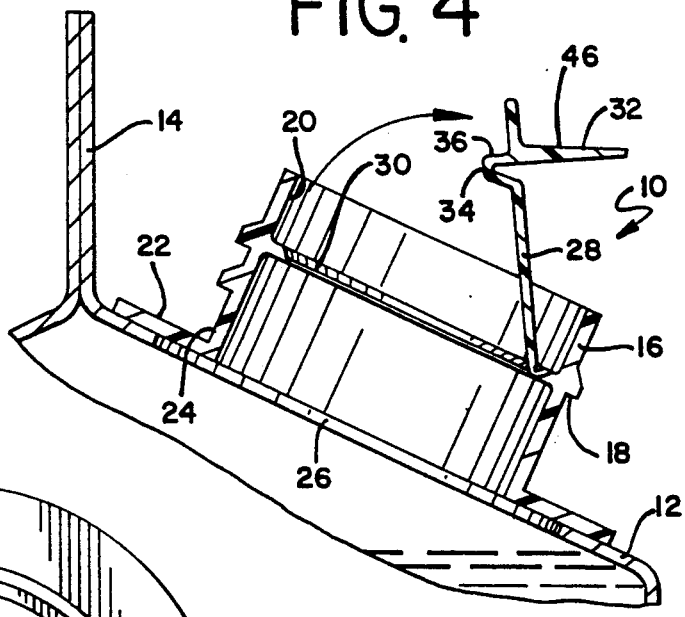
FIG. 4 is another view of the closure of FIG. 3 shown with the pull tab in the opened position.
Figure 5:
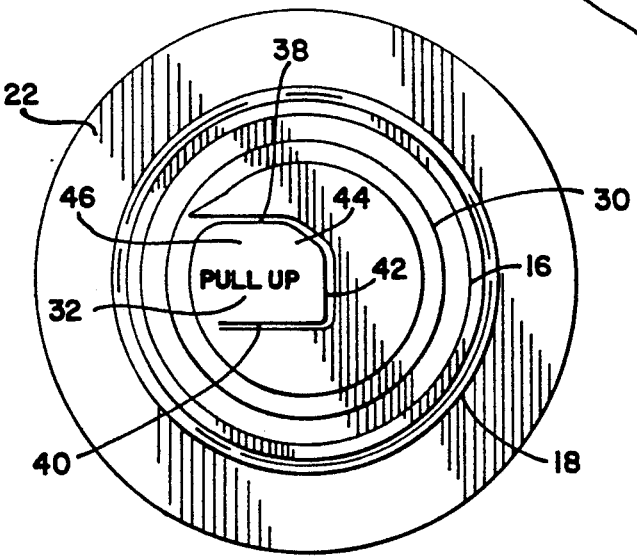
FIG. 5 is a plan view of the closure of the invention shown with the cap removed.

Referring now FIGS. 2–4, the closure 10 includes a tubular spout 16 having an outer threaded surface 18, an inner cylindrical surface 20, and an annular flange 22 integrally formed with a lower end 24 of the spout 16. The flange 22 extends radially outwardly from the spout 16 and is used to secure the spout to the container 12, an operation which is preferably accomplished by ultrasonic welding or by applying an adhesive to the underside of the flange, or to the corresponding surface of the container 12 prior to the application of the closure 10 to the container. The spout 16 is preferably positioned upon the container 12 so that the spout is in registry with an opening 26 in the container.

A pull ring 28 is integrally formed with the inner surface 20 of the spout 16. The ring 28 is disposed approximately midway up the spout 16 and seals the container 12 prior to opening. A weakened or at least partially scored annular band 30 having portions of reduced cross-section is provided in the ring 28 to facilitate the removal of the ring upon the opening of the closure 10. The band 30 is preferably inwardly spaced from the outer peripheral edge of the ring 28. Prior to the initial opening of the container 12, the presence of the ring 28 in an intact condition assures the user that the closure 10 has not been tampered with.

A finger tab 32 is disposed on the pull ring 28 and is adapted to facilitate the removal of the pull ring from the spout 16 without unintentionally detaching the flange 22 from the container 12. The spout 16, the flange 22, the ring 28 and the tab 32 are preferably molded as an integral unit from a thermoformable plastic material such as polyethylene or polystyrene.

The tab 32 is integral with the ring 28, and is normally biased in a vertical position by means of a hinge 34 which secures a lower edge 36 of the tab 32 to the ring 28. The hinge 34 is basically a depending fold of plastic.

Referring now to FIG. 4, the tab 32 has a pair of side edges 38, 40 and a front edge 42. The side edges 38, 40 are generally parallel. If desired, the side edge 38 of the tab 32 may be provided with a tapered corner at 44 to facilitate assembly of the closure 10. Also, an upper surface 46 of the tab 32 may be provided with an integrally molded message, instructions for the user, or a trademark.

Referring now to FIG. 2, a threaded cap 48 is provided for reclosing the closure 10 upon the removal of the pull ring 26. The cap 48 has a depending skirt 50 which is internally threaded and is dimensioned to threadably engage the threaded outer surface 18 of the spout 16. It is contemplated that the outer surface 52 of the skirt 50 be provided with a plurality of spaced vertical gripping ribs 54 or similar structures to facilitate the unscrewing of the cap 48 from the spout 16. As is the case with the previously described portions of the closure 10, the cap 48 is preferably molded from similar polymeric materials.

Referring now to FIGS. 2–4, in operation, the spout 16, the flange 22, the pull ring 28 and the tab 32 are molded as one unit and positioned upon the container 12 over the opening 26. Adhesive or ultrasonic welding is used to secure the flange 22 to the container 12. The cap 48 is then threaded, preferably by automatic capping machinery, upon the spout 16. In so doing, an underside of the top 56 of the cap 46 engages the vertically biased tab 30 and flexes the tab into an angled position as shown at 58. It has been found that when the side edge 38 is provided with the tapered corner 44, the above-described flexing procedure is facilitated.

Once the consumer wishes to open the closure 10, the cap 48 is unscrewed from the spout 16, causing the tab 32 to spring to a vertical position (best seen in FIG. 3) due to the inherent bias provided by the hinge 34. In this vertical position, the tab 32 is more easily grasped by the user, and also is indicative of any tampering to the closure. The user may then pull the tab 32 to remove the pull ring 28, which is severed along the band 30. The pull ring 28 and the tab 32 are then discarded. If the contents of the now-opened container 12 are not totally spent, the cap 48 may be rethreaded upon the spout 16 to reseal the remaining contents for future use.

Thus, the present tamper evident reclosable spout type closure 10 for containers is designed to dispense potable liquids and is effective in resealing the container after the initial opening. The present closure which is also reliably secured to the container by means of the flange 22, and is economical to produce, in that piercing and threading formations are not required.

While a particular embodiment of the tamper evident pull ring pour spout of the invention has been shown and described, it will be appreciated by those skilled in the art changes and modifications may be made thereto without departing from the invention in its broader aspects and as set forth in the following claims.

What is claimed is:

1. A tamper evident pull ring pour spout closure for a container, comprising:

a tubular spout having an outer threaded surface, an inner surface, and means for attaching said spout to the container;

a pull ring integrally formed in said inner surface of said spout and configured to seal said spout;

a gripping member disposed on said pull ring and adapted to facilitate the removal of said pull ring from said spout, said gripping member being biased to project vertically above said spout;

said gripping member is inherently biased by means of an integral hinge securing a side of said gripping member of said pull ring, said hinge including at least one depending formation which depends below said pull ring; and a threaded cap dimensioned to threadably engage said spout and to reclose said closure upon the removal of said pull ring.

2. The spout as defined in claim 1 wherein said gripping member is designed to be flexed into an angled position when said cap is threaded upon said spout.

3. The spout as defined in claim 1 wherein said gripping member is a finger tab provided with a tapered corner as viewed from above.

4. The spout as defined in claim 1 wherein said means for attaching said spout to said container is an annular flange integral with a lower end of said spout.

5. The spout as defined in claim 4 wherein said flange is configured so that said spout may be positioned upon the container in registry with an opening in the container.

6. The spout as defined in claim 1 wherein the container is a gabled container.

7. The spout as defined in claim 6 wherein the container is made of paperboard.

8. The spout as defined in claim 1 wherein said gripping member is a finger tab having two side edges, one of said side edges being tapered as viewed from above to facilitate flexing of said tab when said cap is threaded upon said spout.

9. A tamper evident pull ring pour spout for a gabled container, comprising:

a tubular spout having an outer threaded surface, an inner surface, and an annular flange integral with a lower end of said spout;

a pull ring integrally formed in said inner surface of said spout and configured to seal said spout;

a gripping member integral with said pull ring and being inherently biased in a vertical position;

said gripping member is inherently biased by means of an integral hinge securing a side of said gripping member to said pull ring, said hinge including at least one depending formation which depends below said pull ring; and a threaded cap dimensioned to threadably engage said spout and to reclose said closure upon the removal of said pull ring, said cap being configured to flex said gripping member into an angled position as said cap is threaded upon said spout.

10. The spout as defined in claim 9 wherein said pull ring is provided with a reduced cross-section in portions near said inner surface of said spout to facilitate the removal of said ring from said spout.

11. The spout as defined in claim 9 wherein said gripping member is a finger tab having two side edges, one of said side edges being tapered at a corner as viewed from above to facilitate flexing of said tab when said cap is threaded upon said spout.

* * * * *